United States Patent [19]

Pernia

[11] Patent Number: 4,491,230

[45] Date of Patent: Jan. 1, 1985

[54] ONE-WAY POUR VALVE

[75] Inventor: Nicholas L. Pernia, Erie, Mich.

[73] Assignee: William McColeman, Southfield, Mich.

[21] Appl. No.: 488,850

[22] Filed: Apr. 26, 1983

[51] Int. Cl.[3] ..... B65D 49/02

[52] U.S. Cl. ..... 215/21

[58] Field of Search ..... 215/21, 26, 29, 17

[56] References Cited

U.S. PATENT DOCUMENTS

| | | | |
|---|---|---|---|
| 489,966 | 1/1893 | Leith . | |
| 572,060 | 11/1896 | Nalder . | |
| 745,566 | 12/1903 | Burke | 215/21 |
| 1,025,855 | 5/1912 | Black . | |
| 1,103,895 | 7/1914 | Staples . | |
| 1,104,594 | 7/1914 | Wigg . | |
| 2,044,171 | 6/1936 | Ilhein . | |
| 2,057,134 | 10/1936 | Cahill . | |
| 2,094,961 | 10/1937 | Quattrin . | |
| 2,100,983 | 11/1937 | Sigman . | |
| 2,144,621 | 1/1939 | Frederick . | |
| 2,232,129 | 2/1941 | Nelson . | |
| 2,380,825 | 7/1945 | Diaz . | |
| 2,382,864 | 8/1945 | Diaz et al. . | |
| 2,385,509 | 9/1945 | Harris . | |
| 2,398,663 | 4/1946 | Oberstadt . | |
| 2,472,950 | 6/1949 | Keenan . | |
| 4,043,473 | 8/1977 | Webb . | |
| 4,258,854 | 3/1981 | Wright | 215/21 |
| 4,307,811 | 12/1981 | Fischer et al. . | |
| 4,411,369 | 10/1983 | Borows | 215/21 |

FOREIGN PATENT DOCUMENTS

| | | | |
|---|---|---|---|
| 1565278 | 4/1980 | United Kingdom | 215/21 |

*Primary Examiner*—Donald F. Norton

*Attorney, Agent, or Firm*—Cullen, Sloman, Cantor, Grauer, Scott & Rutherford

[57] ABSTRACT

A device for preventing refilling of a container such as a bottle is adapted to be slideably inserted into the neck of the container. The device includes a hollow, cylindrical body of plastic which includes an integrally molded shoulder which sealingly engages the neck. A valve assembly and a barrier for preventing access to the valve assembly are slideably received through an open end of the body and are retained therein by a resiliently flexible lip on the body. The valve assembly includes a valve seat provided with integrally molded spacers for supporting the barrier in spaced relationship to the valve. The barrier includes a plurality of screened members having interengaging, circumferential ribs which maintain the screens in spaced relationship to each other.

10 Claims, 5 Drawing Figures

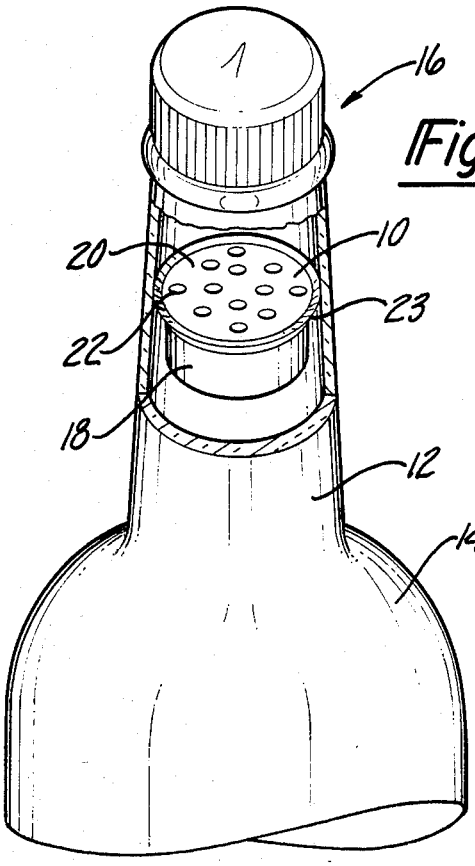
Fig-1
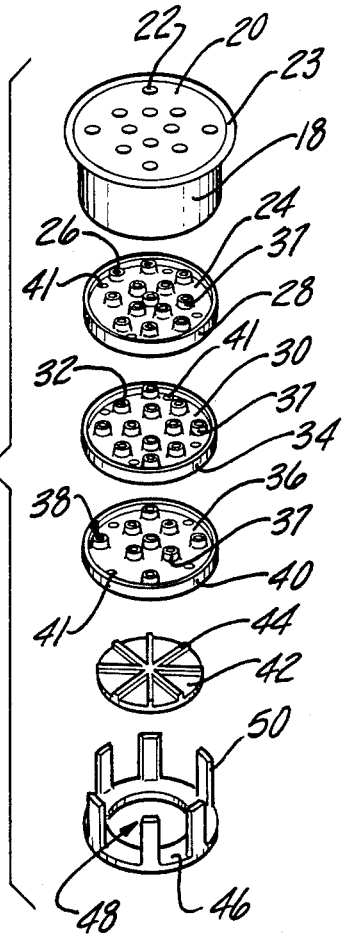
Fig-2
Fig-3
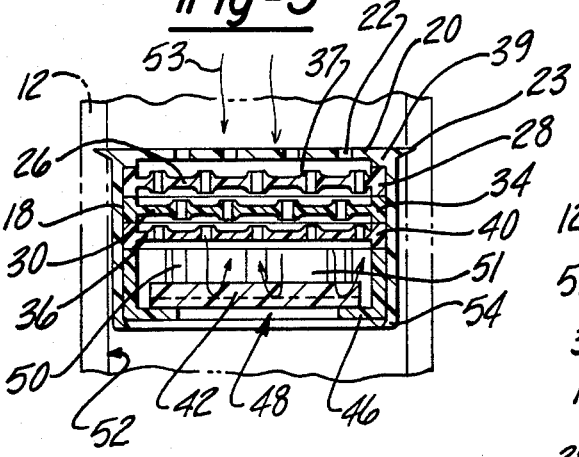
Fig-4
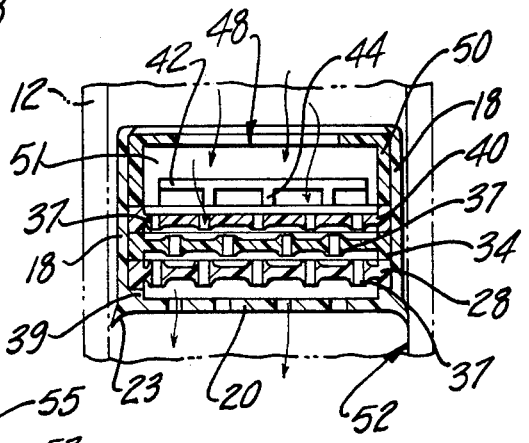
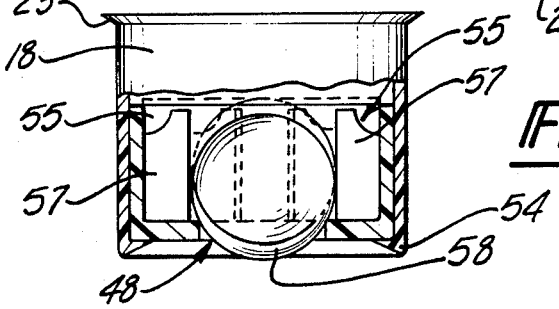
Fig-5

ONE-WAY POUR VALVE

DESCRIPTION

1. Technical Field

The present invention broadly relates to valves for preventing refilling of a container, and deals more particularly with a device which may be inserted into the neck of a bottle which includes a barrier preventing access to the valve.

2. Background Art

Numerous devices have been developed in the past for preventing refilling of containers, such as bottles. These devices are particularly well suited for use with containers for liquor or medicants where it is desired to prevent unscrupulous persons from introducing contaminating substances into the container or refilling the container with contents different from that with which the container was originally filled.

Prior art devices for preventing refilling of a container normally include a valve assembly which allows the contents of the container to be poured from the container in the normal manner but operates to close the neck of the container so as to prevent refilling thereof when the container is positioned in a non-pouring, upright position. Some of these devices also include various types of structure between the valve assembly and the open top of the container which act to prevent ready access to the valve assembly; in this manner, the valve assembly may not be easily defeated.

Each of the prior art devices suffers from one or more disadvantages, the most common of which is the relative complexity of construction and/or difficulty in manufacturing same. These prior art valve devices typically include a multiplicity of pieces which must be individually assembled before installation thereof into the neck of the container. On the other hand, those few prior art valve devices which are relatively simple in construction are also rather ineffective in preventing refilling of the container and may be easily defeated.

Another disadvantage of the prior art devices resides in the fact that in order to provide a fluid tight seal between the valve device and the neck of the container, it is necessary to provide specially configured seals or gaskets which are received within corresponding indentations or the like within the neck of the container; this requires special adaptation of the containers and precludes the use of such devices with conventional containers such as bottles having essentially straight necks. Accordingly, there is a clear need in the art for a device for preventing refilling of containers which is not only simple in terms of construction and economical to fabricate but is also highly effective. The present invention satisfies each of these needs and further provides a device for preventing refilling of a container which may be simply installed in conventional bottlenecks and provides a fluid tight seal between the device and the neck without the need for adaptation of the neck.

SUMMARY OF THE INVENTION

A device for preventing refilling of a container such as a bottle is adapted to be slideably inserted into the neck of the container. The device includes a hollow, cylindrical body of plastic which is provided with an integrally molded, circumferentially extending shoulder that sealingly engages the neck when the device is inserted into the container. A valve assembly and a barrier for preventing access to the valve assembly are slideably received through an open end of the body and are contained therein by a resiliently flexible lip surrounding the opening in the body. The valve assembly includes a valve seat provided with integrally molded spacers which support the barrier in spaced relationship above the valve and guide the movement of a valve member. The barrier includes a plurality of screen members having interengaging, circumferential ribs which maintain the screens in spaced relationship to each other. At least certain of the screens include tubes extending through the apertures which prevent snaking a wire through the screens.

BRIEF DESCRIPTION OF THE DRAWINGS

In the drawings, which form an integral part of the specification and are to be read in conjunction therewith, and in which like reference numerals are employed to designate identical components in the various views:

FIG. 1 is a perspective view of a bottle having the pour valve of the present invention installed therein, portions of the bottleneck being cut away to reveal the pour valve;

FIG. 2 is a perspective, exploded view of the pour valve shown in FIG. 1;

FIG. 3 is a cross-sectional view of the pour valve shown in FIG. 1, the neck of the bottle being shown in phantom with the sealing shoulder being fully extended prior to engagement thereof with the neck;

FIG. 4 is a view similar to FIG. 3 but showing the pour valve turned upsidedown as when the contents are poured out of the bottle, with the sealing shoulder being deflected into sealing engagement with the neck; and, FIG. 5 is a side view of another form of the pour valve of the present invention, parts being broken away in section to reveal the ball valve.

BEST MODE FOR CARRYING OUT THE INVENTION

Referring first to FIGS. 1–4, the present invention is broadly concerned with a one-way pour valve 10 which is adapted to be slideably inserted into the neck 12 through the open top 16 of a container such as a bottle 14. The pour valve device 10 broadly includes a cylindrical body 18, screen members 20, 24, 30 and 36, and a valve assembly including a valve seat 46 and valve member 42.

Body 18 is preferably constructed of plastic and has molded integral therewith a radially outwardly extending, annular shoulder 23 which is resiliently flexible and is disposed around the upper edge of body 18. The upper end of body 18 includes a closure in the form of a screen 20 which is preferably molded integral with the body 18 and includes a plurality of prearranged apertures 22 therein. Body 18 is provided with an annular ledge 39 against which there is seated rib 28 of screen 24.

The lower end of body 18 is substantially open and includes a radially inwardly extending, resiliently flexible lip 54. Each of the screens 24, 30 and 36 is circular in shape and possesses an outside diameter marginally less than the inside diameter of body 18. Screens 24, 30 and 36 each include a corresponding, longitudinally extending rib 28, 34 and 40 around the perimeter thereof for purposes which later will become apparent. Screens 24, 30 and 36 are provided with prearranged apertures 26, 32 and 38 therein, the placement of apertures 22, 26, 32 and 38 being such that the apertures in any two adjacent screens are non-aligned, thus preventing the passage of a tool or the like through more than the top screen 20. Longitudinal tubes 37 formed integral with the screens 24, 30, 36 extend through and beyond each of the apertures 26, 32, 38 and thus form lateral barriers which further discourage a tool such as a wire from being "snaked" through the screens 24, 30, 36. In addition to apertures 26, 32, 38 several peripherally disposed drain holes 41 in the screens 24, 30, 36 are provided.

The valve seat 46 is substantially ring-shaped and includes a central opening 48 therein. A plurality of upstanding, circumferentially spaced fingers 50 are arranged around the perimeter of valve seat 46 immediately adjacent opening 48, and are preferably formed integral with the valve seat 46 as by molding a plastic material. Valve member 42 is circular in shape and possesses a diameter slightly larger than that of opening 48 but slightly less than that of the fingers 50 so as to be longitudinal shiftable along the length of fingers 50. A plurality of radially extending, circumferential spaced ribs 44 are formed on the top side of valve member 42 for purposes which will later become apparent.

The pour valve device 10 is assembled by first pushing the screens 24, 30 and 36 past lip 54 through the opening 48 and then sliding such screens to the top of the body 18. Because of the flexible resiliency of the lip 54, the latter flexes outwardly a sufficient distance to allow passage therethrough of screens 24, 30 and 36. The lip 54 then springs back to its original position, thereby capturing such screens within the body 18. Screens 24, 30 and 36 are held in spaced relationship relative to screen 20 and each other by the ribs 28, 34 and 40 which engage each other around the periphery of the screens. The apertures 22, 26, 32 and 38 are arranged both circumferentially and radially in a pattern such that regardless of the rotational position of each of the screens relative to each other, none of such apertures of adjacent screeens are in longitudinal alignment. Following the insertion of screens 24, 30 and 36, the valve assembly comprising valve seat 46 and valve member 42 is then passed through opening 48, with the lip 54 flexing outwardly once again to accomodate the diameter of valve seat 46. The upper extremities of the upstanding fingers 50 engage rib 40, thereby holding screens 24, 30 and 36 in spaced relationship above the valve seat 46. Thus, a valve chamber 51 is defined between screen 36 and valve seat 46 within which there is captured valve member 42. Valve member 42 is therefore captured within and guided for longitudinal displacement by fingers 50.

As shown in FIG. 3, with the bottle 14 in the upright position, gravity draws valve member 42 downwardly into sealing engagement with valve seat 46. In this position, the opening 48 is blocked, thus preventing any attempt to refill the bottle 14 with liquid indicated by the arrows 53. As implied previously, because of a lack of longitudinal alignment of the apertures 22, 26, 32 and 38, and laterally blocking relationship of the tubes 37, it is not possible to inset an instrument or tool into the valve chamber 51 so as to raise the valve member 42 and thereby permit fluid to flow back into the bottle 14. FIG. 3 also depicts the shoulder seal 23 as being of greater diameter than the inside diameter of the neck 12. FIG. 4 depicts the condition of the pour valve device 10 when the bottle 14 is turned upsidedown as when it is desired to pour contents out of the bottle 14. Gravity draws the valve member 42 downwardly until the ribs 44 engage the bottom surface of screen 36. The ribs 44 maintain spacing between the flat valve member 42 and the screen 36, thereby allowing fluid to flow into the valve chamber 51 and through apertures 38. Fluid passes successively through apertures 38, 32, 26 and 22 and outwardly through the top 16 of the bottle 14. When the bottle 14 is returned to its upright position, the drain holes 41 allow liquid trapped between the screens to drain back into the bottle 14.

The pour valve device 10 is installed in the bottle 14 by simply aligning it in the open top 16 and pushing it downwardly, whereupon the shoulder seal 23 deflects upwardly and inwardly and firmly engages the inner sidewall of the neck 12. The shoulder seal 23 not only securely holds the pour valve device 10 within the neck 12 by friction action, but also provides a tight seal for preventing liquid from passing between the body 18 and neck 12.

Attention is now directed to FIG. 5 wherein an alternate form of valve assembly is depicted. A valve seat having radially extending fins 57 surrounding the opening 48 is employed, however a ball-shaped valve member 58 is provided having a diameter greater than that of opening 48 but less than the diameter between fins 57. With the bottle 14 upright, the ball 58 seats within the opening 48 thereby closing the same. When the bottle is turned upsidedown, the fins 57 guide the ball 58 into engagement with the bottom of screen 36; the ball 58 contacts screen 36 at a relatively small area, thus allowing fluid to flow around the ball 58 outwardly through apertures 38. Cut outs 55 in fins 57 increases circular flow of the liquid around the perimeter of the assembly.

In view of the foregoing, it is apparent that the pour valve device described above not only provides for the reliable accomplishment of the objects of the invention but does so in a particularly simple and economical manner. It is recognized, of course, that those skilled in the art may make various modifications or additions to the preferred embodiment choosen to illustrate the invention without departing from the spirit and scope of the present contribution of the art. Accordingly, it is to be understood that the protection sought and to be afforded hereby should be deemed to extend to the subject matter claimed and all equivalents thereof fairly within the scope of the invention.

I claim:

1. For use with a container having a neck provided with an opening therein through which the contents of said container may be poured, a device for preventing refilling of said container, comprising:

a cylindrically shaped, substantially hollow body having one end thereof essentially open, said body including a circumferential shoulder formed integral with the outer sidewall thereof, said shoulder being resiliently flexible and engaging the inner wall of said neck to form a seal preventing the passage of said contents between said body and said neck;

a valve assembly slideably received within said body for controlling the flow of contents through said device;

a barrier for preventing access to said valve assembly, said barrier being slideably received within said body; and, means on each end of said body for retaining said barrier and said valve assembly within said body.

2. The device of claim 1, wherein said retaining means on said open end of said body includes an annular flexible resilient lip engaging said valve assembly, said lip being sufficiently flexible to flex and thereby allow said barrier and said valve assembly to be slideably received through said open end into said body but being sufficiently rigid to prevent escape of said valve assembly and said barrier from said body.

3. The device of claim 2, wherein said retaining means includes a foraminous closure extending over the other end of said body, said closure being formed integral with said body.

4. A device for preventing refilling of a bottle and adapted to be slideably installed in the neck of said bottle, comprising:

a valve for controlling the flow of contents through said neck;

a plurality of screens above said valve, said screens being disposed adjacent each other and preventing access to said valve; and spacing means for maintaining said screens in longitudinally spaced relationship to each other, said spacing means including a circumferential rib on each of said screens, the rib of each of said screens engaging a rib of an adjacent screen.

5. The device of claim 4, including a substantially hollow, cylindrical body, said screens and said valve being captured within said body, said ribs being in abutment with the inner surface of the circumferential sidewall of said body.

6. The device of claim 4, wherein at least certain of said screen members include a plurality of tubes defining apertures in said screen members.

7. The device of claim 6, wherein said certain screens include at least one drain hole there through.

8. A device for preventing refilling of a bottle or the like having a conventional neck and an opening in the top of said neck through which the contents of said bottle may be poured, comprising:

a body including an outer sidewall closely spaced relative to said neck;

valve means within said body for allowing the contents of said bottle to flow out through said neck but preventing refilling of said bottle through said neck, said valve means including a valve seat having an annular member, a valve chamber above said valve seat and a valve member shiftably disposed within said valve chamber, said valve member being engageable with said valve seat to prevent refilling of said bottle;

a permeable barrier spaced above said valve means to prevent access to said valve means through said opening in said neck; and means extending between said valve means and said barrier for supporting said barrier above said valve means, said supporting means including circumferentially disposed, longitudinally extending structure in said valve chamber between said valve seat and said barrier, said barrier being disposed on and supported by said structure, said annular member being formed integral with said structure, said structure including a plurality of circumferentially spaced, longitudinally extending fingers which closely receive and guide the longitudinal movement of said valve member.

9. The device of claim 8, including a seal for preventing flow of contents between said outer sidewall of said body and said neck, said seal including a flexible shoulder formed integral with and circumscribing said body, said shoulder extending radially outward from said body and into sealing engagement with said neck.

10. A device for preventing refilling of a bottle or the like having a conventional neck and an opening in the top of said neck through which the contents of said bottle may be poured, comprising:

a body including an outer sidewall closely spaced relative to said neck;

valve means within said body for allowing the contents of said bottle to flow out through said neck but preventing refilling of said bottle through said neck;

a permeable barrier spaced above said valve means to prevent access to said valve means through said opening in said neck, said barrier including a plurality of screen members and means for holding said screen members in longitudinally spaced relationship to each other, said holding means including a circumferentially extending rib formed integral on each of said screen members; and, means extending between said valve means and said barrier for supporting said barrier above said valve means.

* * * * *